United States Patent [19]

Amano

[11] 4,454,797

[45] Jun. 19, 1984

[54] AUTOMATIC MUSIC PERFORMING APPARATUS WITH INTERMEDIATE SPAN DESIGNATING FACULTY

[75] Inventor: Takehisa Amano, Hamamatsu, Japan

[73] Assignee: Nippon Gakki Seizo Kabushiki Kaisha, Hamamatsu, Japan

[21] Appl. No.: 412,303

[22] Filed: Aug. 27, 1982

[30] Foreign Application Priority Data

Sep. 7, 1981 [JP] Japan ..... 56-140521

[51] Int. Cl.[3] ..... G10H 7/00

[52] U.S. Cl. ..... 84/1.03

[58] Field of Search ..... 84/1.03, 1.28, DIG. 12, 84/DIG. 22, DIG. 29, 115, 462

[56] References Cited

U.S. PATENT DOCUMENTS 4,406,203 9/1983 Okamoto et al. ..... 84/1.03

*Primary Examiner*—L. T. Hix

*Assistant Examiner*—Douglas S. Lee

*Attorney, Agent, or Firm*—Spensley, Horn, Jubas & Lubitz

[57] ABSTRACT

An apparatus performs automatically a music based on the note data read out from the memory in which are stored a plurality of note data which constitutes a music composition in the form of a paired combination of pitch data and duration data. A starting position in progression of the music composition is designated, and the position in the music composition corresponding to the designated position is searched to start the performance at the designated position.

6 Claims, 9 Drawing Figures

AUTOMATIC MUSIC PERFORMING APPARATUS WITH INTERMEDIATE SPAN DESIGNATING FACULTY

BACKGROUND OF THE INVENTION (a) Field of the Invention

The present invention relates to an apparatus for automatically performing a music, wherein music composition data stored in a memory is read out for automatic performance of music and/or for automatic indication of the positions of the keys to be depressed for music performance.

(b) Description of the Prior Art

Conventional automatic performing apparatus of the above-mentioned type has been arranged to be operative so that, upon depression of a start switch, there is carried out an automatic performance of a music piece, which continues from the beginning to the end of the music composition, so that the user cannot obtain the automatic performance of only a desired specific span (fractional portion) of progression of the music piece. Thus, there has been the inconvenience represented by a lowered efficiency of exercise such that, even when it is desired to repeat a key-fingering exercise for only a specific progression span (fractional portion) of the music piece, being accompanied by automatic performance (either tone accompaniment or indication of individual keys to be depressed after one another), the apparatus will inevitably repeat automatic performance of the whole music piece from the beginning to the end.

SUMMARY OF THE INVENTION

It is, therefore, an object of the present invention to provide a new apparatus for automatically performing a music which can contribute to an improvement of user's exercise efficiency due to the arrangement allowing him to designate, at will, at least the exercise starting position of a progression span (intermediate fraction) of a music piece.

Another object of the present invention is to provide an apparatus of the type as described above, which is simple in arrangement because the keys of the keyboard which are intended for manual performance can be used also for the designation of a progression span.

Still another object of the present invention is to provide an apparatus of the type as described above, which can contribute to a further enhancing of the user's exercise efficiency because of the arrangement that the beginning and the finishing positions of a progression span of a music can be arbitrarily designated.

A further object of the present invention is to provide an appratus of the type as described above, which facilitates the designating operation by an indication of a designated progression span of music.

A still further object of the present invention is to provide an apparatus of the type as described above, which contributes to still further enhancement of the user's exercise efficiency due to repetitive performance of a designated progression span of a music.

DETAILED DESCRIPTION OF THE PREFERRED EMBODIMENTS

Figure 1A:
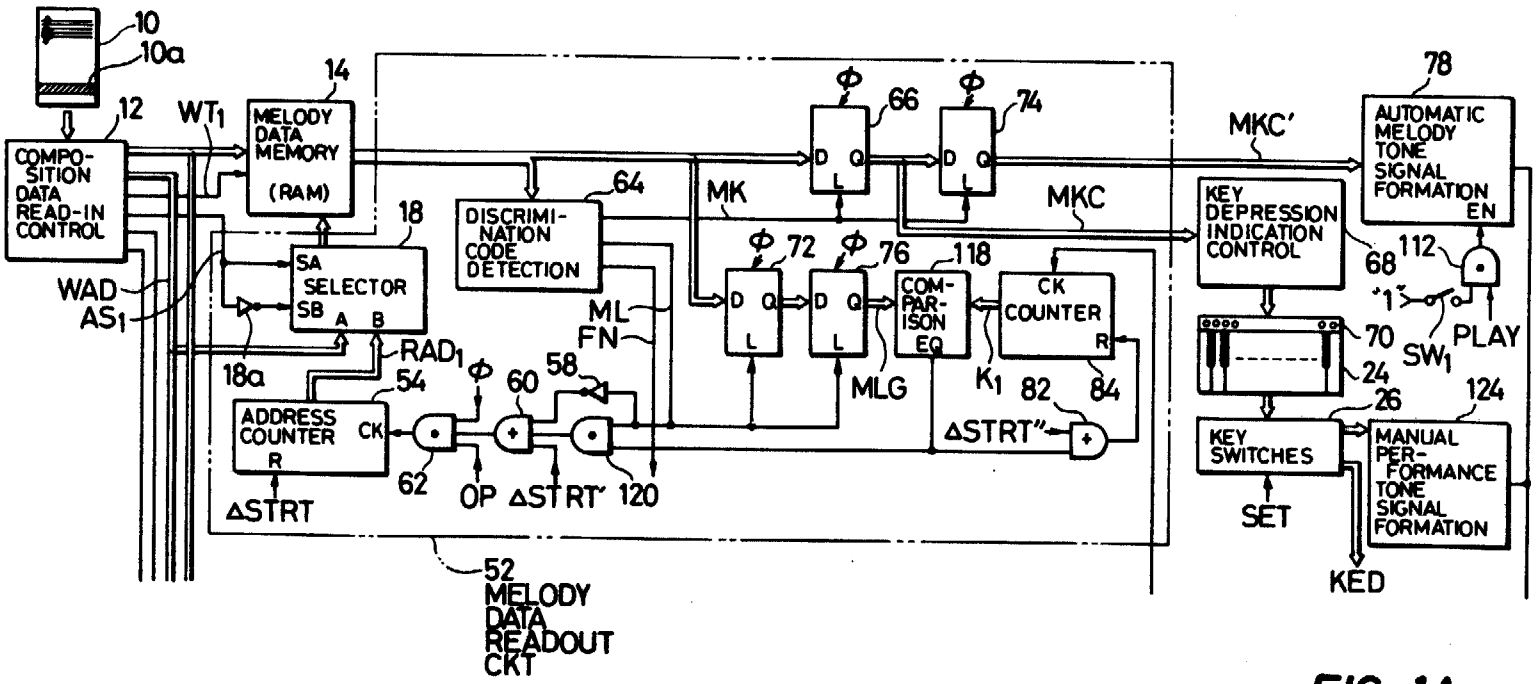
FIGS. 1A and 1B are, in combination, a block diagram of an electronic musical instrument according to an embodiment of the present invention.
Figure 1B:
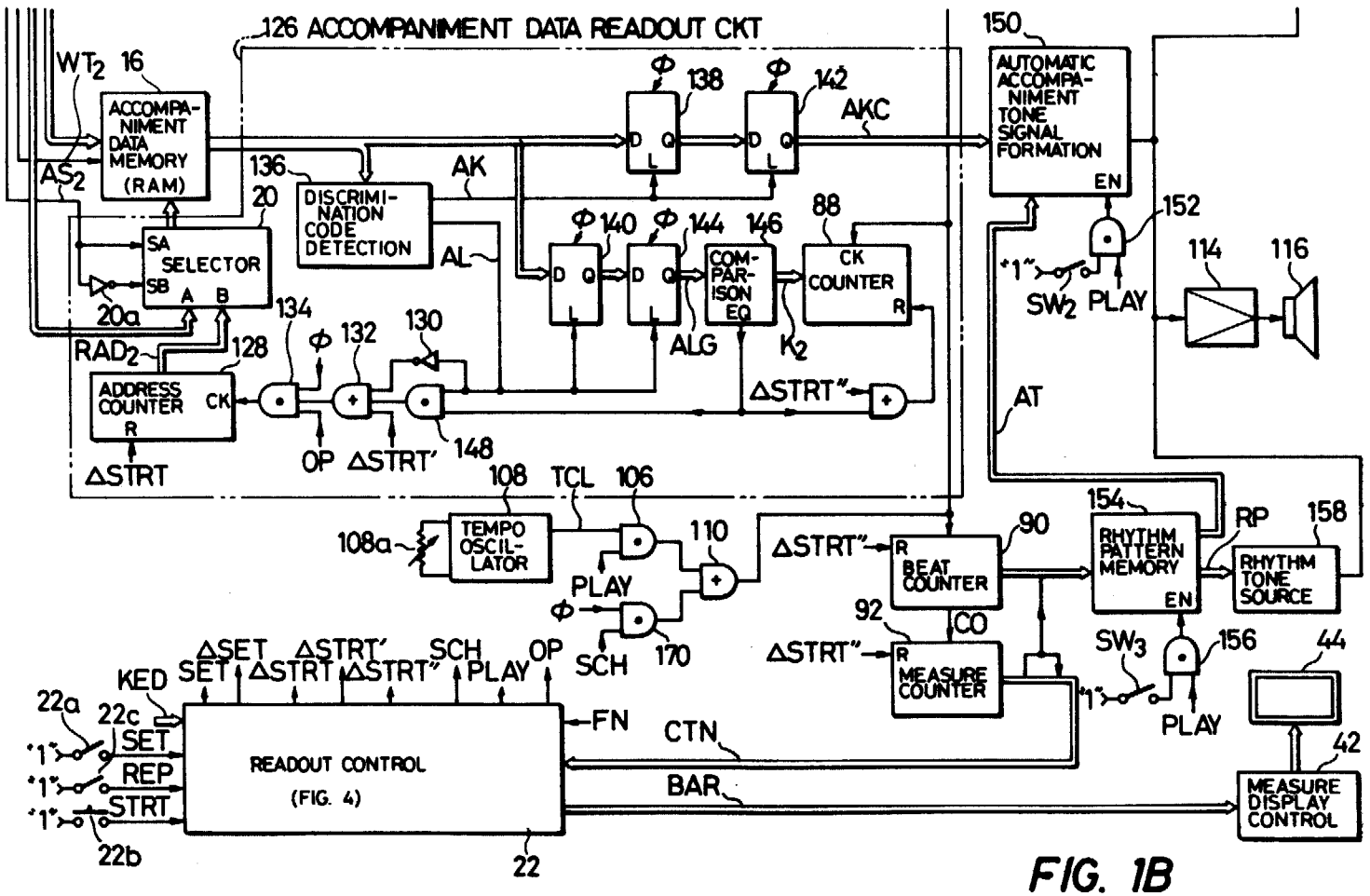

FIGS. 1A and 1B, in combination, show an electronic musical instrument equipped with an automatic music performing apparatus according to a first embodiment of the present invention.

In FIG. 1A, a musical score sheet 10 has, adhered to its lower blank portion thereof, a recording medium **10*a*** such as a one-track magnetic tape on which is magnetically recorded, in the form of serial data, a music composition data corresponding to the contents of the musical composition.

A composition data read-in control circuit 12 is intended to read out composition data from the recording medium **10*a* and transmits a melody data out of this composition data to a melody data memory 14 and also transmits an accompaniment data thereof to an accompaniment data memory 16, for storage therein, respectively. In order to control such transmission-and-storing operations, the composition data read-in control circuit 12 is arranged so as to deliver out a write-in address signal WAD, write-in command signals $WT_1$ and $WT_2$, and address selection signals $AS_1$ and $AS_2$. Each of the memories 14 and 16 is comprised of a RAM (Random Access Memory), and is arranged so that these memories 14 and 16 are supplied with address signals from their mating selector circuits 18 and 20, respectively. The selector circuits 18 and 20 are assigned to make selecting operations in accordance with address selection signals $AS_1$ and $AS_2$, respectively. The selector circuit 18 is arranged to be operative so that, when the level of the selection signal $AS_1$ is "1", the level of its selection input SA will also be "1", so that the circuit 18 selects its input A, whereas when the selection signal $AS_1$ is "0", it is inverted by an inverter 18*a* so that the control input SB is "1", and accordingly the circuit 18 selects its input B. On the other hand, the selector circuit 20 is arranged to be operative so that, when the selection signal $AS_2$ is "1", the control input SA is also "1", and accordingly the circuit 20 selects its input A, whereas, when the selection signal $AS_2$ is "0", it is inverted by an inverter 20*a*, so that the control input SB is "1", and accordingly the circuit 20** selects its input B.

Figure 2:
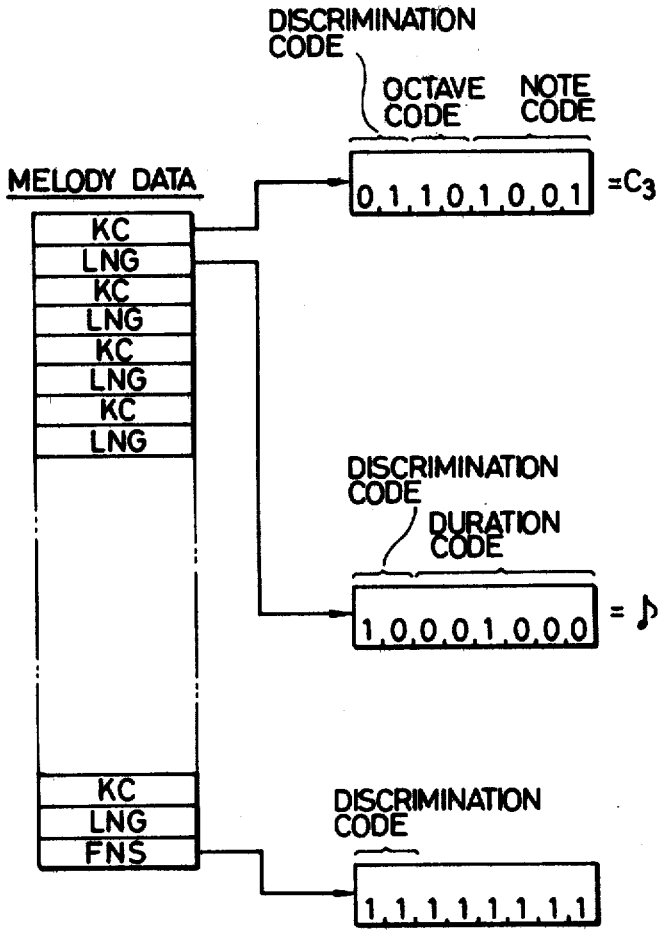
FIGS. 2 and 3 are format diagrams of melody data and accompaniment data, respectively.

A music sheet 10 is set as it is inserted in an inlet of the data read-out unit of the composition data read-in control circuit 12, and a data readout operation is started. Whereupon, the memory 14 is rendered to a writing mode in accordance with a write command signal $WT_1$, so that the memory 14 is supplied with a write address signal WAD from the selector circuit 18 which is in the state of selecting the input A in accordance with a selection signal $AS_1$. As a result, a melody data corresponding to the whole progression of a melody provided on the music sheet 10 is written in the memory 14 in such format as shown in FIG. 2. That is, the melody data which is then written therein is such that the melody note which is to be generated is one indicated by a combination of an 8-bit key code KC and an 8-bit duration code LNG. Each key code KC is arranged so that, as shown by way of example with respect to a note name $C_3$, its highest 2 bits represent a discrimination code, the next 2 bits represent an octave code, and the remaining 4 bits represent a note code. On the other hand, each duration code LNG is arranged, as shown by way of example with respect to a quaver, its upper 2 bits represent a discrimination code, and the remaining 6 bits represent a duration (note duration) code. A rest is indicated by the arranging all of the 6 bits other than the 2-bit discrimination code of the key code KC to be "0". And, a finish code FNS which is comprised of 8 bits which are all "1" is written in the memory 14 after the final melody data has been written. It should be noted here that the highest 2 bits of this finish code FNS represent a discrimination code.

Figure 3:
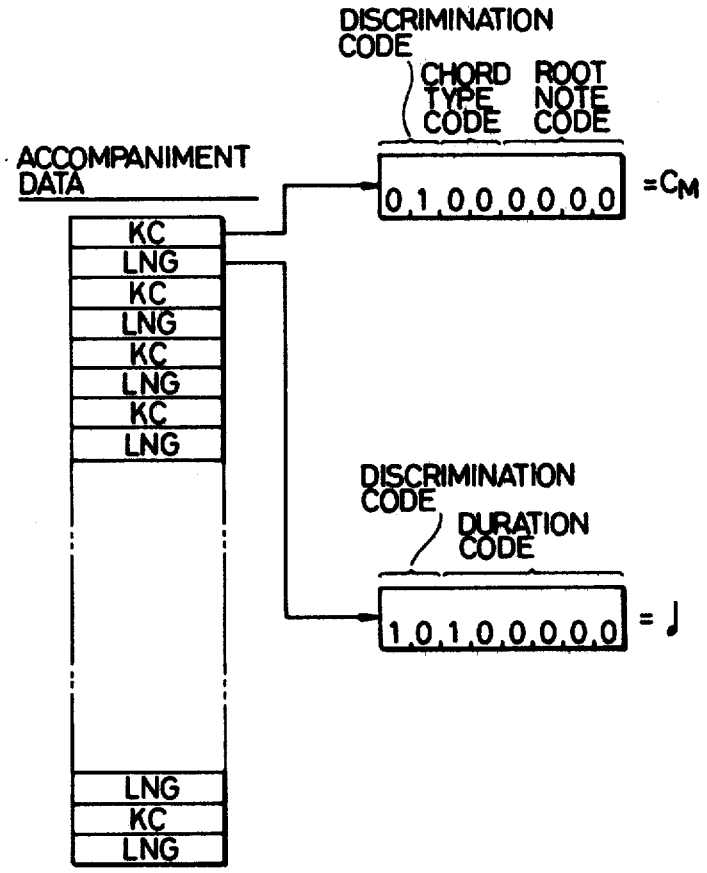

Upon completion of writing of the finish code FNS, the memory 16 is rendered to the writing mode in accordance with a write command signal $WT_2$, and a write address signal WAD is supplied to the memory 16 from the selector circuit 20 which is in the state of selecting the input A in accordance with a selection signal $AS_2$. As a result, accompaniment data corresponding to the progression of the accompaniment (chord notes and base notes) of the music score 10 are written in the memory in such format as shown in FIG. 3. More particularly, the accompaniment data which are then written are such that a chord which is to be generated is expressed by a combination of an 8-bit key code KC and an 8-bit duration code LNG. Each key code KC is so arranged that, as shown by way of example with respect to a C-major ($C_M$) chord, its highest 2 bits represent a discrimination code, the next 2 bits represent a chord type code, and the remaining 4 bits form a root note code. Here, the chord type code is arranged to be "00" for the major chord, "01" for the minor chord, and "10" for the seventh chord. Also, each duration code LNG in the accompaniment data is arranged, as shown by way of example with respect to a half-note (minim), its highest 2 bits represent a discrimination code, and the remaining 6 bits constitute a duration code.

Figure 4:
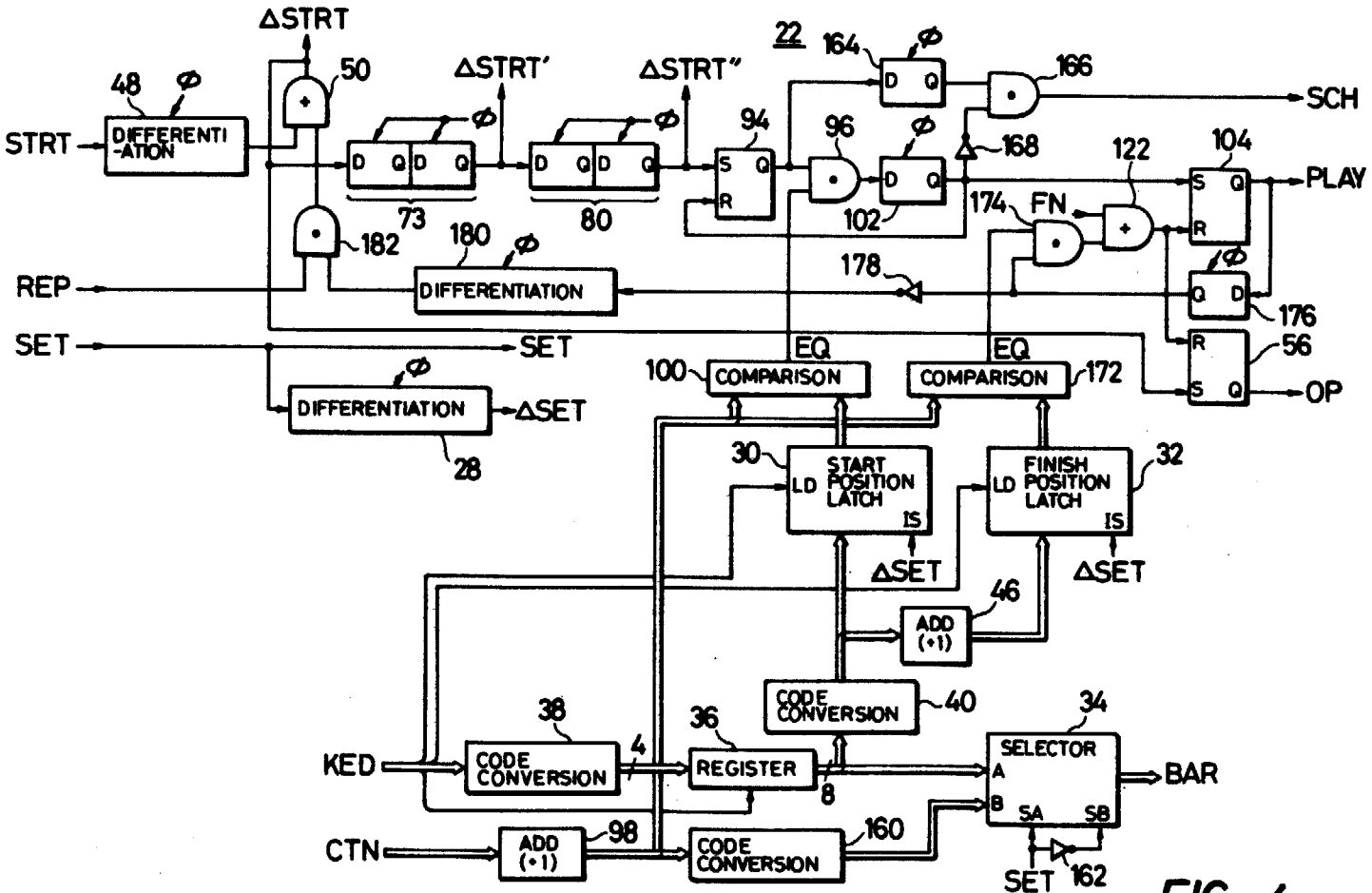
FIG. 4 is a circuit diagram showing the details of a readout control circuit.
Figure 5:
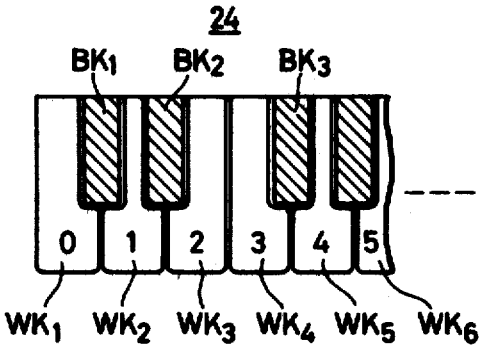
FIG. 5 is a diagrammatic plan view of a keyboard of the instrument.

Now, it should be understood that, either prior to or posterior to such series of data read-out and writing operations as mentioned above, there is carried out a progression span designating operation in the circuitry including a set switch 22*a*, a readout control circuit 22, a keyboard 24 and a key switch circuit 26. More specifically, upon turning the set switch 22*a* "on", a set signal SET which is "1" is delivered out from the readout control circuit 22 as shown in FIG. 4, and this signal is supplied to the key switch circuit 26. The key switch circuit 26, in turn, will supply, in accordance with the set signal SET which is "1", to the readout control circuit 22 a key depression data KED corresponding to a depressed key on the keyboard 24, so that, at the keyboard 24, it becomes possible for the player to arbitrarily designate a progresssion span with respect to the composition data. Here, it should be noted that, on the keyboard 24, the natural keys $WK_1$–$WK_{10}$ are assigned numbers 0–9, respectively, as shown partly in FIG. 5. Arrangement is provided so that, by appropriately operating the natural keys $WK_1$–$WK_{10}$, the player is able to arbitrarily set a starting measure and a finishing measure. Also, sharp keys $BK_1$, $BK_2$ and $BK_3$ are arranged to respectively function as a starting measure load key, a finishing measure load key and a clear key. It should be understood here that there may be provided separate switching means to function in the same way apart from the two groups of keys $WK_1$–$WK_{10}$ and $BK_1$–$BK_3$.

When, in the readout control circuit 22 of FIG. 4, a set signal SET is rendered to "1", this signal SET is differentiated of its rise in synchronism with a system clock pulse signal $\phi$ by a differentiating circuit 28, and is converted to a set pulse ΔSET. This set pulse ΔSET is supplied, as an initial set signal IS, to a start position latching circuit 30 and a finish position latching circuit 32, respectively. In correspondence thereto, a binary data whose least significant bit is "1" and which represents the starting measure is set in the latching circuit 30. Also, a binary data whose all bits are "1" is set in the latching circuit 32. This is to automatically set the apparatus so that, when a designation of the measures is not done specifically at the keyboard, the start of automatic performance begines with the first measure, and the end of the automatic performance will occur when the finish code FNS is read out.

Also, the set signal SET="1" is supplied, as a selection signal SA, to a selector circuit 34, and accordingly the selector circuit 34 is rendered to the state that it selects its input A and delivers it out.

Next, a clear key $BK_3$ is depressed to clear a register circuit 36, and thereafter a setting operation of the start measure and the finish is conducted. Here, as an example, let us assume that the starting measure is the 5th measure and that the finishing measure is the 10th measure. The natural key $WK_6$ (numeral "5") is depressed first, and then the starting measure load key $BK_1$ is depressed. Then, the natural keys $WK_2$ ("1") and $WK_1$ ("0") are depressed successively, and then a finishing measure load key $BK_2$ is depressed.

The key depression key data corresponding to the natural key $WK_6$ is converted from decimal to BCD (binary-coded decimal) notation by a code converting circuit 38, and it is supplied as a 4-bit data to a register circuit 36. This register circuit 36 contains unit registers for two numerical digits, and supplies, to a code converting circuit 40, an 8-bit BCD data corresponding to the 5th measure. The code converting circuit 40 is assigned to convert BCD to binary notation, and supplies, to the starting position latching circuit 30, a binary data corresponding to the 5th measure. As a result, the latching circuit 30 will, when the starting measure load key $BK_1$ is depressed, latch a binary data representing the 5th measure and delivered from the code converting circuit 40. Also, the BCD data corresponding to the 5th measure from the register circuit 36 is supplied, as a measure data BAR, to a measure display controlling circuit 42 of FIG. 1B via the selector circuit 34. Accordingly, the number "5" of the initial measure which is to be started is displayed on a measure indicator 44.

The key depression data corresponding to the natural key $WK_2$ and the key depression data corresponding to the natural key $WK_1$ are first converted from decimal to BCD (binary-coded decimal) notation successively by the code converting circuit 38, and then they are held, in parallel fashion, in the register circuit 36. An 8-bit BCD data corresponding to the 10th measure delivered from the register circuit 36 is first converted, by a code converting circuit 40, to a corresponding binary data, and then it is added with 1 (one) by an adder circuit 46, and is supplied to the finish position latching circuit 32. As a result, when the finishing measure load key $BK_2$ is depressed, the latching circuit 32 latches a binary data supplied from the adder circuit 46 and corresponding to the 11th measure. Also, the BCD data corresponding to the 10th measure which is supplied from the register circuit 36 is supplied, as in the abovesaid instance for the starting measure, to the measure display control circuit 42 via the selector circuit 34. Accordingly, the number "10" of the finishing measure is displayed on the measure indicator 44. The reason why 1 (one) is added by the adder circuit 46 is that the performance of the finishing measure should continue till its end.

When the data readout-and writing operation and the progression span designating operation are completed in such manner as stated above, the player then turns off the set switch 22a of FIG. 1B, and thereafter he turns the start switch 22b "on" to enter into the performance-and-indication mode of operation. More particularly, upon turning on the start switch 22b which is at its "1" level, the start signal STRT is differentiated of its rise in synchronism with a system clock signal $\phi$ by a differentiating circuit 48 shown in FIG. 4. A differentiated output pulse delivered from the differentiating circuit 48 is delivered out, as a start pulse ΔSTRT, via an OR gate 50, and resets an address counter 54 of a melody data readout circuit 52 of FIG. 1A. The start pulse ΔSTRT also sets an R-S flip-flop 56 of FIG. 4. Therefore, the flip-flop 56 delivers out a readout control signal OP which is comprised of the output Q (which is "1") of the flip-flop 56. At this moment, the input signal of an inverter 58 of FIG. 1A is "0" in level, so that an output signal of this inverter 58 which is "1" in level is supplied to an AND gate 62 via an OR gate 60. As a result, when a readout control signal OP which is "1" is generated, the AND gate 62 is enabled to be able to supply a system clock pulse $\phi$ to the address counter 54.

When reset by a start pulse ΔSTRT, the address counter 54 supplies, as an input B, to the selector circuit 18 an address signal $RAD_1$ corresponding to the initial readout address. At this moment, the selector circuit 18 is in the state of selecting its input B by virtue of a selection signal $AS_1$ which is "0", and supplies an initial readout address signal $RAD_1$ to the memory 14. As a result, a key code data corresponding to the initial melody note is read out from the memory 14. Of this data, its highest 2-bit discrimination code signal is supplied to a discrimination code detecting circuit 64 and the remaining 6-bit melody key code (octave code and note code) is supplied to a latching circuit 66 which is timed by a system clock pulse $\phi$.

The discrimination code detecting circuit 64 generates a key code detection signal MK in accordance with the initial key code data delivered from the memory 14. A latching circuit 66 latches the initial melody key code signal in accordance with this key code detection signal MK. And, the melody key code signal MKC delivered from the latching circuit 66 is supplied to a key depression indication control circuit 68. Here, the key depression indication control circuit 68 is so arranged that it makes selective control of lighting up light-emitting devices among an array 70 of light-emitting devices which are provided along with the key array of the keyboard 24, and indicates the keys to be depressed so as to be visible with the player's eye. For this reason, in case the initial melody key code signal MKC indicates a note name $C_3$ as shown in the example of FIG. 2, a light-emitting device corresponding to the key $C_3$ is lighted up.

As stated above, when, after the indication of a key depression corresponding to the initial melody note has been started, the counter 54 counts the clock signals $\phi$, a duration code data corresponding to the initial melody note is read out from the memory 14 in a manner same as that for the preceding instance. Among the readout data at such time, the highest 2-bit discrimination code signal is supplied to the discrimination code detecting circuit 64, and the remaining 6-bit melody duration code signal is supplied to a latching circuit 72 which is timed by the system clock pulse signal $\phi$. And, since the judgement code detecting circuit 64 generates a duration code detection signal ML in accordance with the initial duration code data delivered from the memory 14, a latching circuit 72 latches the initial melody duration code signal in accordance with the duration code detection signal ML. As the duration code detection signal ML at this time is supplied to the inverter circuit 58, the output signal of the inverter 58 becomes "0" in level, and whereby the counting of the counter 54 stops temporarily.

Thereafter, at a time which is delayed by about 2-bit time of the clock signal $\phi$ from the time of generation of the start pulse ΔSTRT, a two-stage D type flip-flop 73 which uses the start pulse ΔSTRT as its input and which is timed by the system clock pulse signal $\phi$ generates a delay signal ΔSTRT'. This delay signal ΔSTRT' enables the AND gate 62 via the OR gate 60 of FIG. 1, so that the counter 54 again counts the system clock signals $\phi$ delivered from the AND gate 62. As a result, a key code data and a duration code data corresponding to the second melody note are read out successively from the memory 14. In response thereto, the discrimination code detecting circuit 64 generates a key code detection signal MK and a duration code detection signal ML in succession. The key code detection signal MK at such time serves to transmit an initial melody key code signal from the latching circuit 66 to a similar latching circuit 74, and also causes the latching circuit 66 to latch the second melody key code signal. Also, the duration code detection signal ML at such time serves to transmit the initial melody note duration code signal from a latching circuit 72 to a similar latching circuit 76, and also causes the latching circuit 72 to latch the second melody note duration code signal, and furthermore causes the counter 54 to temporarily stop its counting via the inverter circuit 58 in a manner same as that stated above.

A melody key code signal MKC of the second melody note delivered from the latching circuit 66 is supplied to the key depression indication control circuit 68. Accordingly, in the array 70 of light-emitting devices, there is carried out an indication of a key to be depressed for the second melody note in the same manner as stated previously. Also, at such time, a melody key code signal MKC' corresponding to the initial melody note delivered from the latching circuit 74 is supplied to an automatic melody note signal forming circuit 78.

As stated above, simultaneously as the duration code data corresponding to the second melody note is read out from the memory 14, it should be understood that, in the readout control circuit 22 of FIG. 4, a two-stage D type flip-flop 80 which is timed by a system clock signal $\phi$ and which uses a delay signal ΔSTRT' generates a delay signal ΔSTRT". This delay signal ΔSTRT" resets a counter 84 via an OR gate 82, and also resets a counter 88 via an OR gate 86, and furthermore resets a beat counter 90 and a measure counter 92 in FIG. 1B.

Also, the delay signal ΔSTRT" resets an R-S flip-flop 94 in FIG. 4. Therefore, the output Q which is "1" of said flip-flop 94 enables an AND gate 96.

Here, let us suppose that a starting measure and a finishing measure have not been set on the keyboard 24. Then, an output data CTN corresponding to the count value 0 of the measure counter 92 of FIG. 1B is added with 1 by an adder circuit 98 of FIG. 4 and it is supplied to a comparing circuit 100, and it is compared with the binary data delivered from the start position latching circuit 30. In such case, since the starting measure has not been set, the start position latching circuit 30 supplies to the comparing circuit 100 a binary data whose least significant bit is "1" and which has been set initially, and therefore the comparing circuit 100 generates a coincidence signal EQ. This coincidence signal EQ sets an R-S flip-flop 104 via the AND gate 96 and further via a D type flip-flop 102 which is timed by the system clock signal $\phi$. Accordingly, the flip-flop 104 regerates a performance command signal PLAY which is comprised of the output Q="1" of the flip-flop 104. It should be noted here that the output Q from the flip-flop 102 serves to reset the flip-flop 94.

The performance command signal PLAY enables an AND gate 106 of FIG. 1B. Accordingly, a tempo clock signal TCL delivered from a tempo oscillator 108 whose oscillation frequency is appropriately variably set by a variable registor 108*a* is supplied to the counters 84 and 88 and to the beat counter 90 via the AND gate 106 and further via an OR gate 10 of FIG. 1B.

The performance command signal PLAY also serves to enable an AND gate 112 of FIG. 1A, and accordingly this AND gate 112, when the sounding selector switch $SW_1$ is turned "on", supplies an enable signal EN to the automatic melody note signal forming circuit 78. As a result, the automatic melody note signal forming circuit 78 electronically synthesizes a melody note signal in accordance with the initial melody key code signal MKC', and supplies same to a loudspeaker 116 via an output amplifier 114. As a result, the loudspeaker 16 pronounces an initial automated melody sound with a delay of one note time relative to the key depression indication (instruction).

On the other hand, a melody duration code signal MLG corresponding to the initial melody note delivered from the latching circuit 76 is supplied to a comparing circuit 118 as one of its comparison inputs. As the other comparison input of this comparing circuit 118, there is supplied a count output $K_1$ from the counter 84 which counts said tempo clock signal TCL. As a result, when the count value of the counter 84 reaches a value corresponding to the note duration indicated by the initial melody note duration code signal MLG, the comparing circuit 118 generates a coincidence signal EQ.

The coincidence signal EQ at such time resets the counter 84 via the OR gate 82. Accordingly, after being reset, the counter 84 again counts the tempo clock signals TCL. Also, the coincidence signal EQ is supplied to the AND gate 62 from the AND gate 120 which has been enabled by a duration code detection signal ML and via the OR gate 60. Accordingly, the counter 54 resumes the counting of the system clock signals $\phi$ delivered from the AND gate 62. As a result, a key code data and a duration code data corresponding to a third melody note are read out in succession from the memory 14, and in the latching circuits 74 and 66 are latched the second melody key code signal and the third melody key code signal, respectively. On the other hand, the second melody duration code signal and the third melody duration code signal are latched in the latching circuits 76 and 72, respectively. Accordingly, in the automatic melody note signal forming circuit 78, there is formed a melody note signal corresponding to the second melody note. Concurrently, in the array 70 of light-emitting devices, there is carried out a key depression indication (instruction) corresponding to the third melody note. Also, in the comparing circuit 118, there is carried out a measurement of note duration for the second melody note. And, by repetition of the abovementioned operations for further progressions of music, there are accomplished an automatic key depression indication based on the data stored in the memory 14 and an automatic performance of a melody note which is delayed by one note time relative to this indication.

It should be noted here that a finish code data is read out finally from the memory 14. In response thereto, the discrimination code detecting circuit 64 generates a finish code detection signal FN. This finish code detection signal FN resets the flip-flop 104 and 56 via the OR gate 122 of FIG. 4, and therefore the performance command signal PLAY and the readout controlling signal OP are both rendered to "0", and thus the reading out of a series of data from the memory 14 completes.

The key switch circuit 26 is so arranged that, when the set signal SET is "0", it supplies to a manual performance note signal forming circuit 124 key depression data corresponding to the key depressions on the keyboard 24. As a result, the manual performance note signal forming circuit 124 electronically synthesizes, in response to the key depression data received from the key switch circuit 26, melody note signals corresponding to the depressed keys, and supplies same to the loudspeaker 116 via the output amplifier 114. Thus, the melody notes resulting from the manual performance are outputted also from the loudspeaker 116.

In such instance, let us assume that a manual performance exercise is conducted on the keyboard 24. It is possible to conduct an efficient performance exercise while listening to the abovestated automatic performance sounds and/or while watching automatic key depression indication exhibited by the array 70 of light-emitting devices. And, in such performance exercise, it is possible also to appropriately utilize an automatic accompaniment by chords and base sound and/or an automatic rhythm accompaniment as will be described below.

In the accompaniment data readout circuit 126, an address counter 128 is reset by a start pulse ΔSTRT when the abovesaid start switch 22*b* is enabled. Also, at such time, the input signal of an inverter 130 is "0". Accordingly, the output signal, which is "1", of the inverter 130 is supplied to an AND gate 134 via an OR gate 132. Accordingly, the AND gate 134 is enabled when a readout controlling signal OP which is "1" is generated from the flip-flop 56 of FIG. 4, so as to supply a clock signal $\phi$ to the address counter 128.

When reset by a start pulse ΔSTRT, the address counter 128 supplies, to the selector circuit 20 as its input B, an address signal $RAD_2$ corresponding to the initial readout address. At such time, the selector circuit 20 is in its state of selecting its input B by a selection signal $AS_2$ which is "0", and supplies an initial readout address signal $RAD_2$ to the accompaniment data memory 16. As a result, a key code data corresponding to an initial accompaniment note is read out from the memory 16. The highest 2-bit discrimination code signal of the key code data is supplied to a discrimination code detecting circuit 136, and the remaining 6-bit accompaniment key code (chord type code and root note code) signal is supplied to a latching circuit 138 which is timed by the system clock signal $\phi$.

The discrimination code detecting circuit 136 generates a key code detection signal AK in accordance with an initial key code data delivered from the memory 16. The latching circuit 138 latches an initial accompaniment key code signal in accordance with this key code detection signal AK.

When, subsequently, the counter 128 counts the system clock signals $\phi$, a duration code data corresponding to the initial accompaniment note is read out from the memory 16 in a manner similar to that described above. Among the readout data at such time, the highest 2-bit discrmination code signal is supplied to the discrimination code detecting circuit 136, and the remaining 6-bit accompaniment note duration code signal is supplied to a latching circuit 140 which is timed by the system clock pulse signal $\phi$. And, the discrimination code detecting circuit 136 generates a duration code detection signal AL in accordance with the initial duration code data delivered from the memory 16. Accordingly, the latching circuit 140 latches the initial accompaniment note duration code signal in accordance with the duration code detection signal AL. Also, the duration code detection signal AL at such time is supplied to the inverter 130. As a result, the output signal of this inverter 130 becomes "0", and it disables the AND gate 134 via the OR gate 132. Accordingly, the counting of the counter 128 is temporarily comes to a halt.

Subsequently, the abovesaid delay signal ΔSTRT' enables the AND gate 134 via the OR gate 132. Accordingly, the counter 128 again counts the system clock signals $\phi$ delivered from the AND gate 134. As a result, a key code data and a duration code data corresponding to the second accompaniment note are read out successively from the memory 16. In response thereto, the discrimination code detecting circuit 136 generates a key code detection signal AK and a duration code detection signal AL successively. The key code detection signal AK at such time serves to transmit, from the latching circuit 138, the initial accompaniment key code signal to a latching circuit 142 which is similar to said latching circuit 138, and concurrently it causes the latter latching circuit 138 to latch the second accompaniment key code signal. Also, the duration detection signal AL at such time serves to transmit, from the latching circuit 140, the initial accompaniment note duration code signal to a latching circuit 144 which is similar to said latching circuit 140, and concurrently it causes the latching circuit 140 to latch the second accompaniment note duration code signal, and furthermore causes the counting of the counter 128 to stop temporarily via the inverter 130 in the same way as that described previously.

As a result of the above-stated operations, an initial accompaniment key code signal AKC becomes to be delivered out from the latching circuit 142, and also an initial accompaniment note duration code signal ALG becomes to be delivered out from the latching circuit 144. And, this initial accompaniment note duration code signal ALG is supplied to a comparing circuit 146 to be compared therein with a count output $K_2$ of the counter 88 which counts said tempo clock signals TCL. As a result, when the count value of the counter 88 reaches a value corresponding to the note duration indicated by the initial accompaniment note duration code signal ALG, the comparing circuit 146 generates a coincidence signal EQ.

The coincidence signal EQ at such time resets the counter 88 via the OR gate 86. Therefore, after being reset, the counter 88 again counts the tempo clock signals TCL. Also, the coincidence signal EQ is supplied to the AND gate 134 via the OR gate 132 from an AND gate 148 which is enabled by the duration code detection signal AL, and therefore, the counter 128 resumes the counting of the system clock signals $\phi$ delivered from the AND gate 134. As a result, a key code data and a duration code data corresponding to a third accompaniment note are read out successively from the memory 16, and a second accompaniment key code signal and a third accompaniment key code signal are latched in the latching circuits 142 and 138, respectively. And, a second accompaniment note duration code signal and a third accompaniment note duration code signal are latched in the latching circuits 144 and 140, respectively. As a result, a second accompaniment key code signal AKC is delivered out from the latching circuit 142, and a second accompaniment note duration code signal ALG is delivered out from the latching circuit 144. Also, in the comparing circuit 146, measurement of note duration with respect to the second accompaniment note is conducted. And, subsequently, the above-described operations are repeated, and thus accompaniment data are read out successively from the memory 16, so that accompaniment key code signals AKC are delivered out successively from the latching circuit 142. It should be noted here that the read-out operation of data from the memory 16 completes prior to the read-out of the finish data from the memory 14, and that the counter 128 ceases its advancement simultaneously with the counter 54 when the finish data is read out from the memory 14 and when, accordingly, the readout control signal OP returns to "0".

In this way, the accompaniment key code signal AKC which is delivered out from the accompaniment data readout circuit 126 is supplied to an automatic accompaniment signal forming circuit 150. When an enable signal EN is supplied to the automatic accompaniment note signal forming circuit 150 in response to the enabling of a sounding selection switch $SW_2$ from an AND gate 152 which is enabled by a performance command signal PLAY, the automatic accompaniment note signal forming circuit 150 electronically synthesizes accompaniment note signals based on the accompaniment key code signals AKC and on a rhythm selection data not shown. The automatic accompaniment note signal forming circuit 150 will generate, as the accompaniment note signals, chord signals corresponding to a plurality of chord-forming notes and base note signals which meet the chords and the rhythm to be generated. And, the timing of delivering out individual accompaniment note signals from the automatic accompaniment signal forming circuit 150 is adapted to be controlled in line with the rhythm in accordance with an accompaniment timing signal AT delivered from a rhythm pattern memory 154, and the accompaniment note signals from the circuit 150 are supplied to the loudspeaker 116 via the amplifier 114. Accordingly, automatic accompaniment sounds also are outputted from the loudspeaker 116.

The rhythm pattern memory 154, when it is supplied, from an AND gate 156 which is enabled by a performance command signal PLAY, with an enable signal EN in response to the enabling of a rhythm selection switch $SW_3$, is adapted to generate a rhythm pattern signal RP, in addition to said accompaniment timing signal AT, in accordance with the count output of the beat counter 90 which counts said tempo clock signals TCL and also with the least significant bit signal among the count outputs of the measure counter 92 which counts the carryout CO of the beat counter 90. This rhythm pattern signal RP is supplied to a rhythm note supplying circuit 158. The rhythm note supplying circuit 158 is intended to drive, in accordance with the rhythm pattern signal RP, appropriate rhythm note sources to generate rhythm note signals, and their rhythm note signals are supplied to the loudspeaker 116 via the output amplifier 114. Accordingly, automatic rhythm sounds also are outputted from the loudspeaker 116. It should be noted here that the reason why the least significant bit signal among the count outputs of the measure counter 92 is supplied to the rhythm pattern memory 154 is that the rhythm pattern is formed based on a 2-measure unit.

Figure 6:
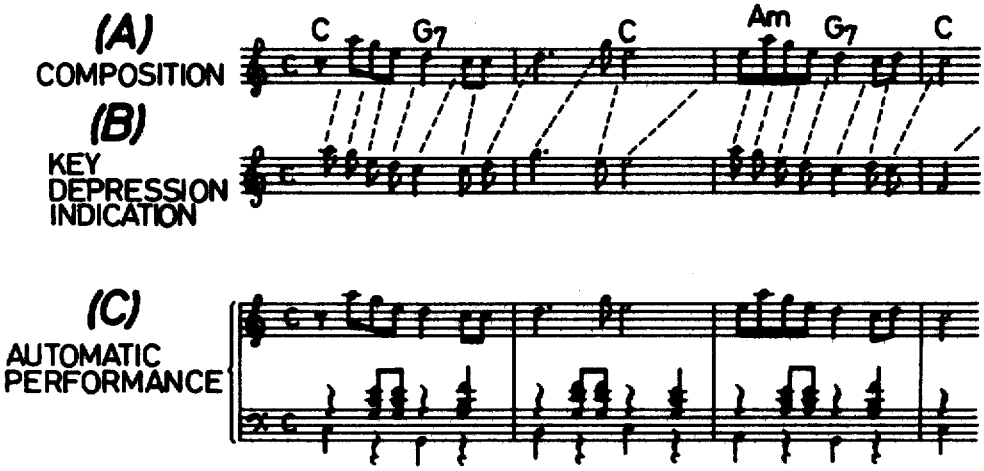
FIGS. 6(A) to 6(C) are illustrations for explaining indication-and-performance operations.

FIG. 6 shows an example of the performance-and-indication operations of the above-mentioned electronic musical instrument. FIG. 6(A) shows a progression of notes of the music composition; FIG. 6(B) shows the timing of key depression indication; and FIG. 6(C) shows the automatic performance timing of melody and accompaniment. According to FIG. 6, it will be clearly noted that the key depression indication is one note time in advance relative to the automatic melody note. That is, each key to be depressed is indicated during the time of the preceding note performance.

In the above-mentioned performance-and-indication operations, the count output CTN of the measure counter 92 is supplied to a code converting circuit 160 via the adder circuit 98 of FIG. 4 to be converted from a decimal to a binary code data. And, the binary code data from the code converting circuit 160 is supplied, as a measure data BAR, to the measure display controlling circuit 42 of FIG. 1B via the selector circuit 34 which is in the state of selecting the input B by a selection signal SB which is "1" and which is formed by inverting by an inverter 162 the set signal SET which is "0". As a result, during the performance-and-indication operations, there is displayed the number of the now progressing measure on the measure indicator 44.

Description has been made above with respect to an embodiment arranged so that a starting measure and a finishing measure have not been set preliminarily on the keyboard 24, so that the performance-and-indication operations are conducted continuously beginning with the first measure through to the last measure of the music composition 10. Hereinbelow, however, description will be made of the operations of the instance wherein the 5th measure is designated as the starting measure and the 10th measure is designated as the finishing measure preliminarily on the keyboard 24.

In such instance, it is to be noted that the operations up until the flip-flop 94 is set in accordance with the delay signal ΔSTRT in FIG. 4 are similar to those stated with respect to the preceding embodiment. When the flip-flop 94 is set, its output Q which is "1" is supplied to an AND gate 166 via a D type flip-flop 164 which is timed with a clock signal $\phi$. At such time, the AND gate 166 is enabled by an output "1" of an inverter 168 which uses, as its input, an output Q "0" of the flip-flop 102. As a result, the output Q which is "1" of the flip-flop 164 is delivered out as a search command signal SCH via the AND gate 166 to be supplied to and AND gate 170 shown in FIG. 1B.

The AND gate 170 is enabled in accordance with the search command signal SCH, and accordingly it will deliver out high-speed clock signals $\phi$. These clock signals $\phi$ are supplied to the counters 84 and 88 and also to the beat counter 90 via the OR gate 110. Accordingly, there are conducted, at high speed, such data readout operation and also the counting by the counters 90 and 92 as described above in accordance with the high-speed clock signals $\phi$. And, when the count value of the measure counter 92 reaches "4", the comparing circuit 100 of FIG. 4 detects a coincidence between the output of the adder circuit 98 and the start position latching circuit 30 and delivers out a coincidence signal EQ. This coincidence signal EQ is delivered out via the AND gate 96 and the flip-flop 102 to reset the flip-flop 94, and on the other hand, it renders the search command signal SCH to "0" level via the inverter 168, and furthermore the signal EQ sets the flip-flop 104 to render the performance command signal PLAY to "1" level. As a result, in a manner similar to that described above, display and performance operations are started, beginning with the 5th measure, in accordance with the tempo clock signal TCL.

Thereafter, when the count value of the measure counter 92 reaches "10", a comparing circuit 172 of FIG. 4 detects an agreement between the output of the adder circuit 98 and the output of the end position latching circuit 32, and delivers out a coincidence signal EQ to and AND gate 174. At this time, the AND gate 174 is enabled by a performance command signal PLAY supplied from a D type flip-flop 176 which is timed with the clock signal $\phi$. Accordingly, the coincidence signal EQ from the comparing circuit 172 resets the flip-flops 104 and 56 via the AND gate 174 and further via the OR gate 122. As a result, both the performance command signal PLAY and the readout control signal OP are rendered to "0" level, so that the performance-and-indication operations will cease at the 10th measure.

When the performance command signal PLAY returns to "0" level and when, accordingly, the output Q of the flip-flop 176 becomes "0" level, the output of an inverter 178 which uses, as its input, said output which is "0" will become "1" level. The output of the inverter 178 at such time is differentiated of its rise by a differential circuit 180 in synchronism with the clock signal $\phi$, and its differential output pulse is supplied to an AND gate 182. Here, let us assume that the repeat switch **22*c* of FIG. 1B has been preliminarily enabled. Then, since a repeat signal REP which is "1" delivered from the switch 22*c* has enabled the AND gate 182, the differential output pulse from the differentiating circuit 180 is delivered out as a start pulse ΔSTRT via the AND gate 182 and further via the OR gate 50. As a result, the condition at such time will become identical to the instance wherein the start switch 22*b*** is enabled again. Thus, the performance-and-indication operations beginning with the 5th measure through to the 10th measure including the searching operation are repeated.

It should be noted here that, in the performance and indication operations of the 5th to the 10th measures, the number of the progressing measure is displayed by the measure indicator 44 in the same manner as in the preceding embodiment.

What is claimed is:

1. An apparatus for automatically performing a music, comprising:

note data memory means storing a plurality of note data for forming a music composition comprised of paired combination of pitch data and duration data;

readout means connected to said note data memory means for successively reading out said note data by successive accessing of the note data stored in said note data memory means;

start position designating means for designating a start position in said music composition at which a performance based on said note data having been read out is to be started;

position searching means connected to said readout means for searching positions of readout note data contained in said music composition;

start position detecting means connected to said start position designating means and to said position searching means to compare said designated start position with searched positions to thereby detect a performance starting position in said music composition upon coincidence established between these two positions as a result of the comparison;

control means connected to said readout means and to said start position detecting means to control said readout means, in accordance with the detection of the designated start position in said music composition, to successively access the note data stored in said note data memory means at a speed determined by each duration data contained in each of said note data beginning with the note data at the designated start position, to thereby form a performance signal by virtue of the note data read out from said note data memory means as a result of said accessing; and musical tone forming means connected to said readout means to form musical tone signals having respective pitches and durations defined by said performance signal.

2. An apparatus according to claim 1, in which:

said start position designating means is a keyboard which can be used selectively as a keyboard for manual music performance also.

3. An apparatus according to claim 1, further comprising:

finish position designating means for designating a finish position a which the formation of the performance signal based on the readout note data is to be finished; and finish position detecting means connected to said finish position designating means and to said position searching means to compare said designated finish position with searched positions to thereby detect a performance finishing position in said music composition upon coincidence established between these two positions as a result of the comparison, said finish position detecting means being also connected to said readout means whereby said readout means will stop reading out said note data upon detection of said performance finishing position.

4. An apparatus according to claim 1, further comprising:

designated position display means connected to said start position designating means to display the start position designated by said start position designating means.

5. An apparatus according to claim 1, further comprising:

repeating means connected to said control means to render said control means to resume the successive accessing by said readout means of the note data contained in said note data memory means after a finish of formation of said music performance signal.

6. An apparatus for automatically instructing a music performance, in an electronic musical instrument, comprising:

note data memory means storing a plurality of note data for forming a music composition comprised of paired combination of pitch data and duration data;

readout means connected to said note data memory means for successively reading out said note data by successive accessing of the note data stored in said note data memory means;

start position designating means for designating a start position in said music composition at which a performance based on said note data having been read out is to be started;

position searching means connected to said readout means for searching positions of readout note data contained in said music composition;

start position detecting means connected to said start position designating means and to said position searching means to compare said designated start position with searched positions to thereby detect a performance starting position in said music composition upon coincidence established between these two positions as a result of the comparison;

control means connected to said readout means and to said start position detecting means to control said readout means, in accordance with the detection of the designated start position in said music composition, to successively access the note data stored in said note data memory means at a speed determined by each duration data contained in each of said note data beginning with the note data at the designated start position, to thereby form a performance signal by virtue of the note data read out from said note data memory means as a result of said accessing; and indicating means connected to said readout means to successively indicate playing positions on said electronic musical instrument corresponding to respective note pitches defined by said performance signal.

* * * * *